US005969482A

United States Patent [19]

Gradzki

[11] Patent Number: 5,969,482

[45] Date of Patent: Oct. 19, 1999

[54] CIRCUIT ARRANGEMENT FOR OPERATING A DISCHARGE LAMP INCLUDING REAL POWER SENSING USING A SINGLE QUADRANT MULTIPLIER

[75] Inventor: Pawel M. Gradzki, Potomac, Md.

[73] Assignee: Philips Electronics North America Corporation, New York, N.Y.

[21] Appl. No.: 09/201,046

[22] Filed: Nov. 30, 1998

[51] Int. Cl.[6] ..... G05F 1/00

[52] U.S. Cl. ..... 315/224; 315/307; 315/308

[58] Field of Search ..... 315/224, 307, 315/291, 247, 244, DIG. 5, 308

[56] References Cited

U.S. PATENT DOCUMENTS

| | | | |
|---|---|---|---|
| 5,103,142 | 4/1992 | Daub | 315/308 |
| 5,103,143 | 4/1992 | Daub | 315/308 |
| 5,523,656 | 6/1996 | Luuresma | 315/308 |
| 5,578,908 | 11/1996 | Persson | 315/307 |
| 5,734,232 | 3/1998 | Hendrix et al. | 315/307 |
| 5,739,643 | 4/1998 | Usui | 315/224 |

*Primary Examiner*—Don Wong
*Assistant Examiner*—Wilson Lee
*Attorney, Agent, or Firm*—Jack D. Slobod

[57] ABSTRACT

A circuit arrangement for supplying a controlled substantially constant level of electrical power to a discharge lamp in a load circuit includes a feedback loop responsive to a comparison or difference between a power measure signal corresponding to electrical power consumed by the lamp and a reference signal corresponding to a desired consumed power. The power measure signal is formed by a power measure signal forming circuit which includes a one quadrant multiplier which receives at a pair of inputs respective lamp voltage and lamp current measure signals output from a sample and hold device arranged for sampling both a signal indicative of instantaneous lamp voltage and a signal indicative of instantaneous lamp current. The sampling is done at instants at which a signal which is indicative of the derivative of the lamp voltage passes through zero in a predetermined direction. The latter signal constitutes the current through a capacitor which is coupled at one end to a voltage that is indicative of the instantaneous lamp voltage and at the other end to a voltage clamp.

6 Claims, 2 Drawing Sheets

CIRCUIT ARRANGEMENT FOR OPERATING A DISCHARGE LAMP INCLUDING REAL POWER SENSING USING A SINGLE QUADRANT MULTIPLIER

BACKGROUND OF THE INVENTION

1. Field of the Invention

The present invention relates to a circuit arrangement for supplying a controlled substantially constant level of electrical power to a discharge lamp in a load circuit, the arrangement including a feedback loop responsive to a comparison or difference between a power measure signal substantially corresponding to electrical power consumed by the lamp and a reference signal corresponding to a desired consumed power, which power measure signal is formed by a power measure signal forming circuit which includes a multiplier which receives at a pair of inputs respective lamp voltage and lamp current measure signals formed by sensing the load circuit.

2. Description of the Related Art

Such a circuit arrangement is known from U.S. Pat. No. 5,075,602, which is assigned to an affiliate of the assignee of the present application.

In the known circuit arrangement, the instantaneous value of current through a load circuit which includes a discharge lamp and the instantaneous value of voltage across the ends of the load circuit forming a resonant tank are multiplied in a four quadrant multiplier to form a product which is averaged to represent average power supplied to the load circuit. The four quadrant multiplier is more costly and complex than a single quadrant multiplier. Further, the power measured in this circuit arrangement is not only the power consumed by the discharge lamp, since it also includes losses of the resonant tank circuit and power consumed in filament heating.

In U.S. Pat. No. 5,734,232, which is also assigned to the affiliate of the assignee of the present application, the power measure signal is obtained by multiplying in a one quadrant multiplier the absolute values of instantaneous signals indicative of lamp voltage and current. In the event that capacitive current is present in the load circuit i.e. a phase shift exists between the lamp voltage and current waveforms, calculation in the manner indicated can lead to a substantial error by including reactive as well as real components.

SUMMARY OF THE INVENTION

It is an object of the present invention to provide a circuit arrangement for powering a discharge lamp, which arrangement includes a feedback loop responsive to a measure of power consumed in the lamp, which measure of power is formed utilizing a single quadrant multiplier.

It is a further object of the present invention that the measure of power formed is of real power, i.e. the measurement is insensitive to capacitive load circuit current as may be produced due to the presence of stray capacitances in the wiring and in the lamp fixture.

Briefly, the aforementioned and other objects are satisfied by providing a circuit arrangement for supplying a controlled substantially constant level of electrical power to a discharge lamp which includes a power measure signal forming circuit which comprises a sample and hold device arranged for sampling both a signal substantially indicative of instantaneous lamp voltage and a signal substantially indicative of instantaneous lamp current in response to passage through zero of a signal which is substantially indicative of the derivative of the lamp voltage, the sample and hold device having a pair of outputs respectively feeding the pair of inputs of the multiplier. By triggering the sampling of the signals substantially indicative of lamp voltage and lamp current, respectively, at the instant that the signal substantially indicative of the derivative of the instantaneous lamp voltage passes through zero, it is assured that the signals sampled by the sample and hold device are sampled at the instant at which the lamp voltage is at its peak. Consequently, to the extent the lamp approximates a real load, the product of the lamp voltage and current samples obtained at this instant are substantially proportional to real lamp power.

The circuit arrangement of the present invention is further characterized in that the multiplier is a one quadrant multiplier, and the sample and hold device is arranged such that it samples the signals substantially indicative of instantaneous lamp voltage and instantaneous lamp current only in response to detection of the passage through zero in a predetermined direction of the signal which is substantially indicative of the derivative of the lamp voltage. Causing the sampling in response to only one direction of passage through zero of the signal which is substantially indicative of the derivative of the lamp voltage assures that in dependence on the one direction chosen, only a positive peak, or only a negative peak, of the instantaneous lamp voltage is sampled. Since the lamp current is at or near its peak at the instant it and the lamp voltage are sampled, only a one quadrant multiplier is needed to multiply the samples indicative of lamp voltage and current.

The circuit arrangement of the present invention is still further characterized in that the signal which is substantially indicative of the derivative of the instantaneous lamp voltage is a current through a capacitor which is coupled at one end to a voltage that is substantially indicative of the instantaneous lamp voltage. Further, the other end of the capacitor is connected to a voltage clamp. The clamp acts to limit the voltage across the current sensor to a small dynamic range about zero, in order that the current in the series combination of the capacitor and the clamp is determined substantially solely by the capacitor.

Other objects, features and advantages of the present invention will become apparent upon perusal of the following detailed description when taken in conjunction with the appended drawing, wherein:

DETAILED DESCRIPTION OF THE PREFERRED EMBODIMENTS

Figure 1:
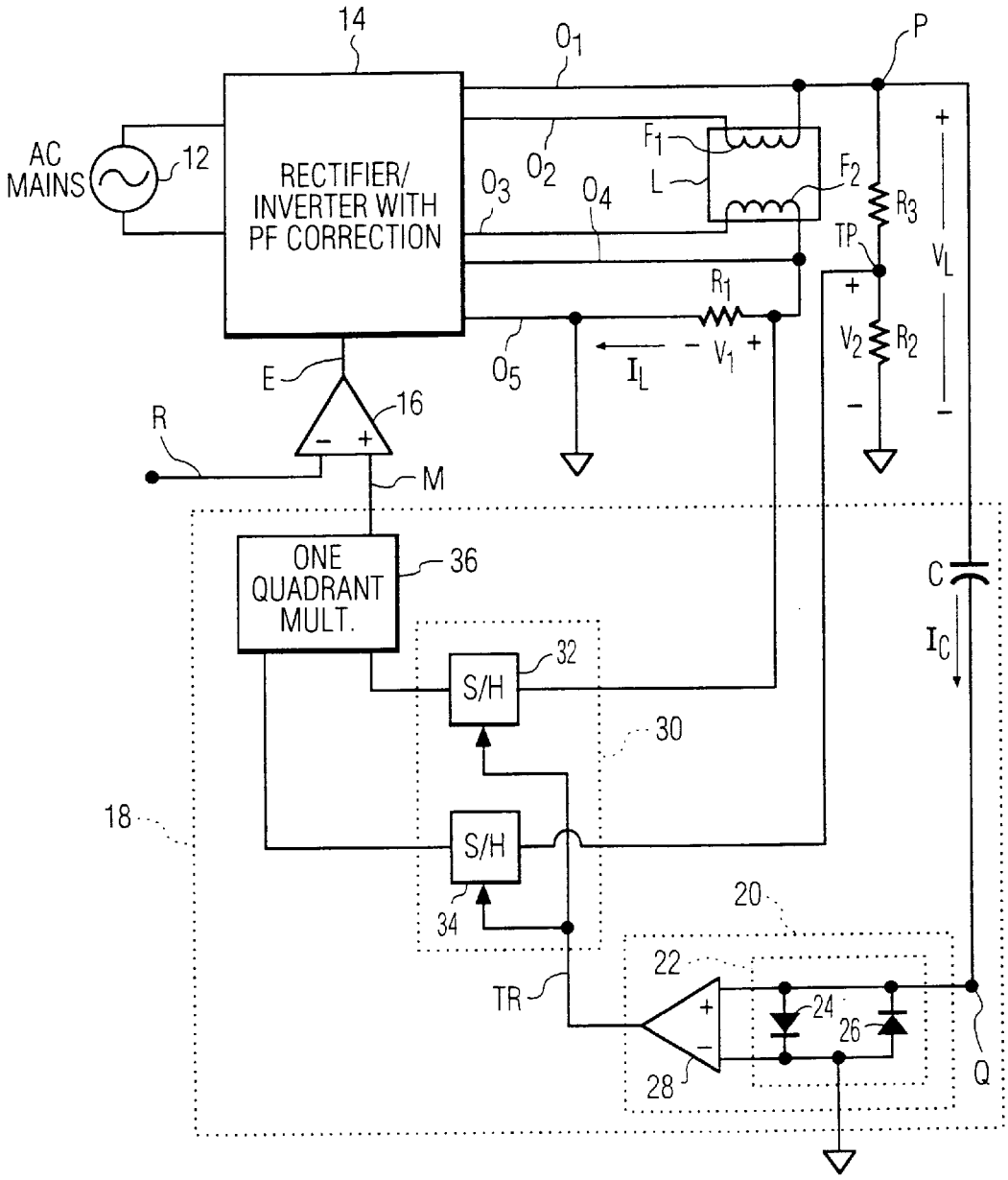
FIG. 1 shows an exemplary schematic of an arrangement for supplying electrical power to a discharge lamp in accordance with the present invention, which arrangement is responsive to input reference voltage R indicating the average power to be supplied to the discharge lamp.

Referring first to FIG. 1 of the drawing, there is shown an arrangement for powering a discharge lamp L from power lines, for example AC mains 12 via a rectifier/inverter unit 14. Discharge lamp L has filaments $F_1$, $F_2$ at its opposite ends which are powered by filament voltages applied by unit 14 between output lines $O_1$ and $O_2$, and between output lines $O_3$ and $O_4$, respectively. Filaments $F_1$, $F_2$ also serve as electrodes between which the discharge is formed due to the lamp voltage $V_L$ applied by unit 14 between output lines $O_1$ and $O_5$, line $O_1$ being the high voltage line and line $O_5$ being connected to ground. The filament electrodes $F_1$, $F_2$ exchange roles as anode and cathode as the direction of voltage across the lamp is alternated at a frequency above the range of human hearing. Rectifier/inverter unit 14 is well known in the art and converts the low frequency AC mains voltage, such as 110 Volts RMS at 60 Hz to a somewhat higher voltage range, for example about 200 to 300 Volts RMS necessary to start and maintain the discharge, and a considerably higher frequency range, for example 40 to 120 KHz, and includes power factor correction. Unit 14 is responsive to an error signal E formed by a differential amplifier or comparator 16 in response to an input reference signal R and a measure M of power consumed by lamp L which is formed by measure signal forming circuit 18, the elements 14, 16, and 18 being part of a feedback loop for maintaining the power $P_L$ consumed by lamp L at the level indicated by reference signal R. Reference signal R may be supplied from a potentiometer (not shown) or a digital to analog converter (not shown).

The feedback loop includes the sensing of voltages $V_1$ and $V_2$ which are substantially indicative of the instantaneous lamp current $I_L$ and the instantaneous lamp voltage $V_L$, respectively. The voltage $V_1$ appears across a resistor $R_1$ in series with the lamp L, and via which the lamp L is connected to output line $O_5$. The voltage $V_2$ is tapped from a tap TP of a voltage divider across the lamp voltage $V_L$; the voltage divider is formed by the series resistors $R_2$, $R_3$.

In the rectifier/inverter 14, primarily the frequency of the applied lamp voltage is varied in response to error signal E, the lamp current and lamp power generally decreasing as the frequency is increased above that which achieves operation of discharge lamp L at about 100% of its rated power. The ability to vary frequency over a range of 2:1 or more enables the lamp to operate over a wide range of power, and be significantly dimmed as desired in response to the power level indicated by reference signal R.

In accordance with the present invention, a capacitor C is connected at one end to a point P having a voltage which is substantially indicative of the instantaneous lamp voltage $V_L$ and its other end to an input Q of a sample and hold device square wave forming section 20 which produces a square wave having edges at each passage through zero of the current $I_C$ through capacitor C. The voltage at point Q is intended to be negligible as compared with the voltage at point P so that the current $I_C$ is substantially indicative of the derivative of the instantaneous lamp voltage, since the current through a capacitor equals the value of the capacitance thereof times the temporal derivative of the voltage across the capacitor. Preferably point P is at the high voltage line $O_1$ as shown in FIG. 1, rather than at the voltage divider tap TP, for example, so that the voltage at point Q is negligible as aforementioned, and capacitor C can have a reasonably realizable value. Also, preferably the voltage at point Q is maintained small by configuring zero crossing detector by forming a voltage clamp 22 which bidirectionally clamps or limit the voltage at point Q to a small maximum absolute value. The voltage clamp may be formed as shown by a pair of oppositely directed parallel diodes 24, 26 between point Q and ground, as shown, and the voltage between point Q and ground are fed to the differential inputs of a high gain differential amplifier or comparator 28. Alternatively, point Q may be the current input of an amplifier (not shown) which converts current to voltage, the current input including an inherent voltage clamp or virtual ground at its input formed by one or more base-emitter junctions (not shown). The output of sample and hold device square wave forming section 20 is fed to the triggering or clock input TR of a sample and hold device sampling section 30. A positively directed edge corresponds to the current $I_C$ passing through zero going from negative to positive and a negatively directed edge corresponds to the current $I_C$ passing through zero going from positive to negative.

Sample and hold device sampling section 30 comprises a sample and hold element 32 which receives voltage $V_1$ which is proportional to the lamp current $I_L$ and a sample and hold element 32 which receives voltage $V_2$ which is proportional to the lamp voltage $V_L$. Both sample and hold elements 32, 34 are triggered by the output from sample and hold device square wave forming section 20, and in particular by only a positively directed edge or by only a negatively directed edge. This assures that voltages $V_1$ and $V_2$ are sampled at each instant that the lamp VL is at a positive peak, or at a negative peak, depending on the edge direction to which sample and hold elements 32, 34 are sensitive. The outputs of sample and hold elements 32, 34 feed different ones of the two inputs of a one quadrant multiplier 36, in which the inputted values are multiplied to form the power measure signal M at the output multiplier 36.

Figure 2:
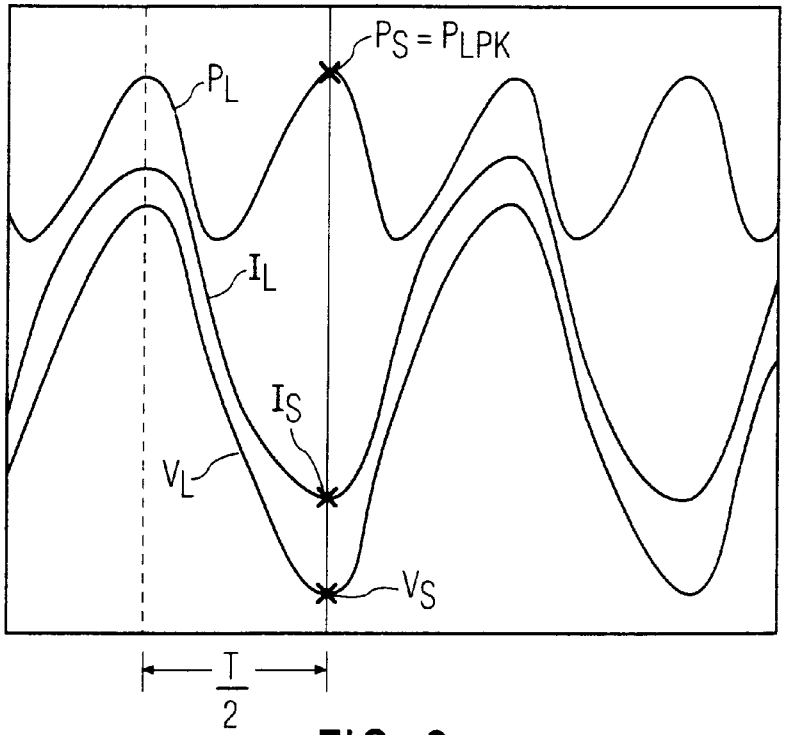
FIG. 2 shows graphs versus time of lamp power $P_L$, lamp current $I_L$, and lamp voltage $V_L$ obtained with the circuit arrangement circuit of FIG. 1, with the lamp at about 100% of its rated average power.
Figure 3:
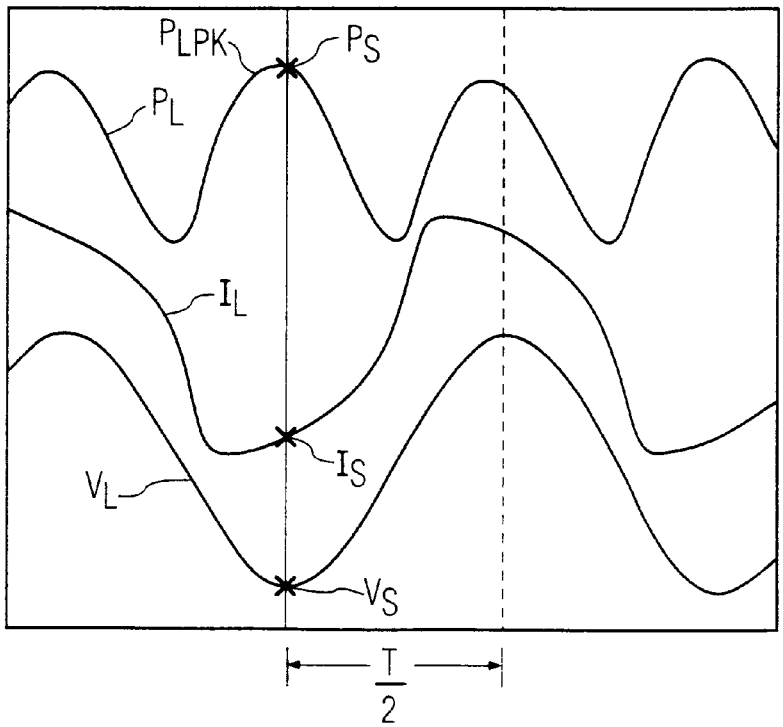
FIG. 3 shows graphs versus time of lamp power $P_L$, lamp current $I_L$, and lamp voltage $V_L$ obtained with the circuit arrangement circuit of FIG. 1, with the lamp at about 15% of its rated average power, the scale of the abscissa and ordinates being different than in FIG. 2.

That the measure signal is proportional to the real power consumed by lamp L will be apparent upon review of FIGS. 2 and 3 which illustrate the waveforms of instantaneous lamp current $I_L$ and voltage $V_L$ versus time obtained experimentally with a typical discharge lamp operated at about 100% and about 15% of rated average power, respectively, the instantaneous lamp power $P_L$ versus time shown therein being computed as the product of the instantaneous lamp voltage and lamp current. The various ordinate scales and the abscissa scale are not the same in FIG. 2 as they are in FIG. 3. For example, in FIGS. 2 and 3 the current and voltage half period T/2 is 11.7 $\mu$s and 5.64 $\mu$s, respectively, corresponding to a frequency of 42.49 kHz and 88.71 kHz, respectively. As can be seen from FIGS. 2 and 3, while the lamp voltage is generally sinusoidal for both illustrated operating conditions, the lamp current is generally sinusoidal for the 100% average power condition but departs considerably from a sinusoidal shape for the 15% average power condition. In each of the these Figures, the current and voltage sampled at a sampling instant determined by the derivative of the lamp voltage passing through zero from negative to positive are labeled $I_S$ and $V_S$, respectively, and their product is labeled $P_S$.

As is well known for ideal sinusoidal current and voltage which are in phase with each other, the peak power determined by the product of the peak current and the peak voltage is twice the average power. For the condition of 100% of rated power operation shown in FIG. 2, the ratio between the power $P_S$ determined as the product of the sampled current $I_S$ and the sampled voltage $V_S$ and the actual average lamp power is 1.98, whereas for the condition of 15% of rated power operation shown in FIG. 3, the ratio between the power $P_S$ determined as the product of the sampled current $I_S$ and the sampled voltage $V_S$ and the actual average lamp power is 1.74. This shows that the product of the sampled current and voltage are substantially proportional to the average power of the lamp throughout the range of power level operating conditions.

It should now be apparent that the objects of the present invention have been achieved. While the present invention has been described in particular detail, it should also be appreciated that numerous modifications are possible within the intended spirit and scope of the invention.

What is claimed is:

1. A circuit arrangement for supplying a controlled substantially constant level of electrical power to a discharge lamp in a load circuit, the arrangement including a feedback loop responsive to a comparison or difference between a power measure signal substantially corresponding to electrical power consumed by the lamp and a reference signal corresponding to a desired consumed power, which power measure signal is formed by a power measure signal forming circuit which includes a multiplier which receives at a pair of inputs respective lamp voltage and lamp current measure signals formed by sensing the load circuit, wherein the power measure signal forming circuit comprises a sample and hold device arranged for sampling both a signal substantially indicative of instantaneous lamp voltage and a signal substantially indicative of instantaneous lamp current in response to passage through zero of a signal which is substantially indicative of the derivative of the lamp voltage, the sample and hold device having a pair of outputs respectively feeding the pair of inputs of the multiplier.

2. The circuit arrangement as claimed in claim 1, wherein the multiplier is a one quadrant multiplier, and the sample and hold device is arranged such that it samples the signals substantially indicative of instantaneous lamp voltage and instantaneous lamp current only in response to the passage through zero in a predetermined direction of the signal which is substantially indicative of the derivative of the lamp voltage.

3. The circuit arrangement as claimed in claim 1, wherein the signal which is substantially indicative of the derivative of the instantaneous lamp voltage is a current through a capacitor which is coupled at one end to a voltage that is substantially indicative of the instantaneous lamp voltage.

4. The circuit arrangement as claimed in claim 2, wherein the signal which is substantially indicative of the derivative of the instantaneous lamp voltage is a current through a capacitor which is coupled at one end to a voltage that is substantially indicative of the instantaneous lamp voltage.

5. The circuit arrangement as claimed in claim 3, wherein the other end of the capacitor is connected to a voltage clamp.

6. The circuit arrangement as claimed in claim 4, wherein the other end of the capacitor is connected to a voltage clamp.

* * * * *